US006501496B1

(12) United States Patent
Kawabata

(10) Patent No.: US 6,501,496 B1
(45) Date of Patent: Dec. 31, 2002

(54) PACKAGING BODY AND IMAGE FORMING METHOD FOR UTILIZING PACKAGING BODY

(75) Inventor: Kouya Kawabata, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 93 days.

(21) Appl. No.: 09/698,210

(22) Filed: Oct. 30, 2000

(30) Foreign Application Priority Data

Oct. 28, 1999 (JP) ..... 11-307553

(51) Int. Cl.[7] ..... B41J 2/315
(52) U.S. Cl. ..... 347/171
(58) Field of Search ..... 347/171, 50, 214, 347/215–219, 221; 400/207, 208, 219.5, 220, 223, 236; 206/462

(56) References Cited

U.S. PATENT DOCUMENTS

| | | | | |
|---|---|---|---|---|
| 5,131,539 A | * | 7/1992 | Karita et al. | 206/462 |
| 5,244,092 A | * | 9/1993 | Karita et al. | 206/462 |
| 5,280,307 A | | 1/1994 | Parsons | 346/134 |
| 5,323,178 A | | 6/1994 | Mohnkern et al. | 346/76 L |
| 5,428,371 A | | 6/1995 | Fox et al. | 347/262 |
| 6,341,844 B1 | * | 1/2002 | Uchikata et al. | 347/50 |

FOREIGN PATENT DOCUMENTS

| | | | |
|---|---|---|---|
| JP | 2-14436 | 4/1990 | B41J/31/00 |
| JP | 2-14437 | 4/1990 | B41J/31/00 |
| JP | 2883499 | 2/1999 | B41J/13/22 |
| JP | 11-216918 | 8/1999 | B41J/13/22 |

OTHER PUBLICATIONS

Patent Abstract of Japan, 11–216918, Aug. 10, 1999, Sota et al., Method for Forming Laser Thermal Tranfer Image.

* cited by examiner

*Primary Examiner*—John S. Hilten
*Assistant Examiner*—K. Feggins
(74) *Attorney, Agent, or Firm*—Sughrue Mion, PLLC

(57) ABSTRACT

In a packaging body, an ink sheet or an image receiving sheet for laser heat transfer recording is wound onto a winding core and a flange is mounted to at least one end portion of the winding core and the packaging body is packaged into a packing material such as a carton box or the like. In the image forming method, the ink sheet and the image receiving sheet which are respectively wound up in rolls, are taken out from the packaging bodies, loaded onto rack(s), and then respectively pulled out from the rack(s). The ink sheet and the image receiving sheet are irradiated image-wise with a laser in a state in which they are superposed to thereby form an image.

22 Claims, 4 Drawing Sheets

PACKAGING BODY AND IMAGE FORMING METHOD FOR UTILIZING PACKAGING BODY

BACKGROUND OF THE INVENTION

1. Field of the Invention

The present invention relates to a packaging body and more specifically to a packaging body for packaging an ink sheet or an image receiving sheet which is wound in a roll and is for use in a laser heat transfer recording.

2. Description of the Related Art

In a laser transfer recording process, a method is carried out in which an ink sheet for each of yellow, cyan, magenta and the like respectively, is sequentially superposed with an image receiving sheet so as to correspond with each image, and an image for each of the colors is sequentially transferred from the ink sheet to the image receiving sheet to form a multicolored image. The ink sheet and image receiving sheet are respectively loaded on a device called a rack in a state in which they are taken up in a roll.

In general, the ink sheet and the image receiving sheet are respectively taken up onto winding cores and stored in carton boxes. At the time of a recording operation, the ink sheet and image receiving sheet which were taken up onto winding cores are taken from packing materials such as a carton box, or the like and when these sheets are loaded onto the rack(s), flanges are mounted onto the winding core and subsequently, the recording operation is started. In the case of this type of operation, if when the ink sheet and the image receiving sheet are wound onto the winding cores the degree of winding is loose, the ink sheet and the image receiving sheet which are wound onto the winding cores tend to have winding error when loaded onto the rotation rack. Due to the occurrence of this winding error, accuracy in positioning the ink sheet onto the image receiving sheet is poor and obtaining a fine and high quality images becomes difficult.

Further, when the ink sheet and the image receiving sheet are wound onto the winding cores, particularly when the sheets are wound too forcefully, the impressions of the Langston winding (spiral winding) generally used on the winding core tend to remain on the ink sheet and the image receiving sheet. Alternatively, a slight step formed by a final end portion of the sheet (a portion that contacts the winding core) on the outer surface of the winding core, tend to cause undesirable lines on those sheets (cut portion impressions). As in the case above, tight contact of the ink sheet with the image receiving sheet is poor. As a result, it is difficult to obtain a fine and high quality image.

Further, it is necessary to mount the flanges onto the winding core each time the ink sheet and the image receiving sheet which are wound onto the respective winding cores are loaded onto the rack(s), making the operation very complicated. Also, when the flanges are mounted to the winding cores, paper dust is generated and this paper dust may attach to the surface of the sheets which moves from the rack(s) to the print recording section, and as in the case above, cause tight contact of the ink sheet with the image receiving sheet to be poor.

SUMMARY OF THE INVENTION

The object of the present invention is to solve the above problems by providing an ink sheet and an image receiving sheet in which winding error is not generated and impressions, lines and the like, which hinder image formation are not formed on the sheets.

Further, the present invention provides a method for image formation in which a high quality and fine image can be obtained by a simple operation.

In order to achieve the above objects, a packaging body comprises a packing material and at least one sheet packaged therein, wherein the sheet is an ink sheet for laser heat transfer recording having a winding core on which the sheet is wound, the winding core having opposite end portions and a flange mounted to at least one end portion of the winding core.

The second aspect of the present invention is a packaging body comprising a packing material and at least one sheet packaged therein, wherein the sheet is an image receiving sheet for laser heat transfer recording having a winding core on which the sheet is wound, the winding core having opposite end portions and a flange mounted to at least one end portion of the winding core.

The third aspect of the present invention is an image forming method comprising the steps of: providing a packaging body having a packing material and at least one ink sheet for laser heat transfer recording, with the ink sheet wound on an ink sheet winding core and packaged in the packing material and a packaging body having a packing material and at least one image receiving sheet for laser heat transfer recording, with the receiving sheet wound on a receiving sheet winding core and packaged in the packing material, wherein at least one flange is mounted to at least one of the winding cores; removing the ink sheet and the image receiving sheet from its respective packing material; loading the sheets onto at least one rack; selecting an end portion of one winding core which does not have a flange mounted thereto and mounting another flange to the selected end portion; dispensing the ink sheet and the image sheet from its respective rack; superposing the ink sheet and the image receiving sheet; and irradiating a laser beam imagewise onto the ink sheet and the image receiving sheet while they are superposed to thereby form an image.

DESCRIPTION OF THE PREFERRED EMBODIMENTS

The preferred embodiments of the present invention are described below. The winding core which takes up the sheet stored within the packaging body of the present invention will be described. Note that "sheet" when used here refers to both the ink sheet and the image receiving sheet.

Figure 1:
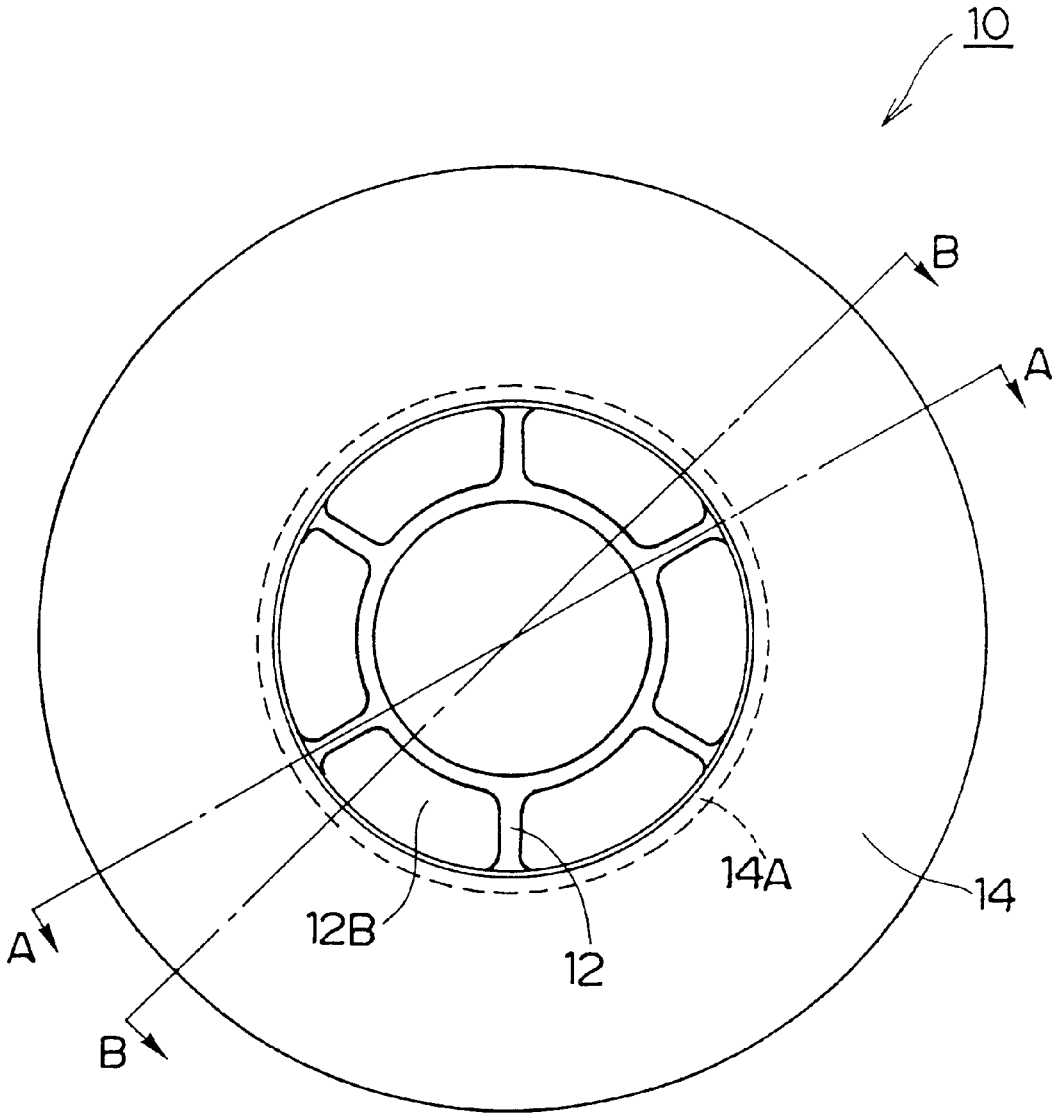
FIG. 1 is a plan view of a preferred embodiment of a flange of the present invention.
Figure 2:
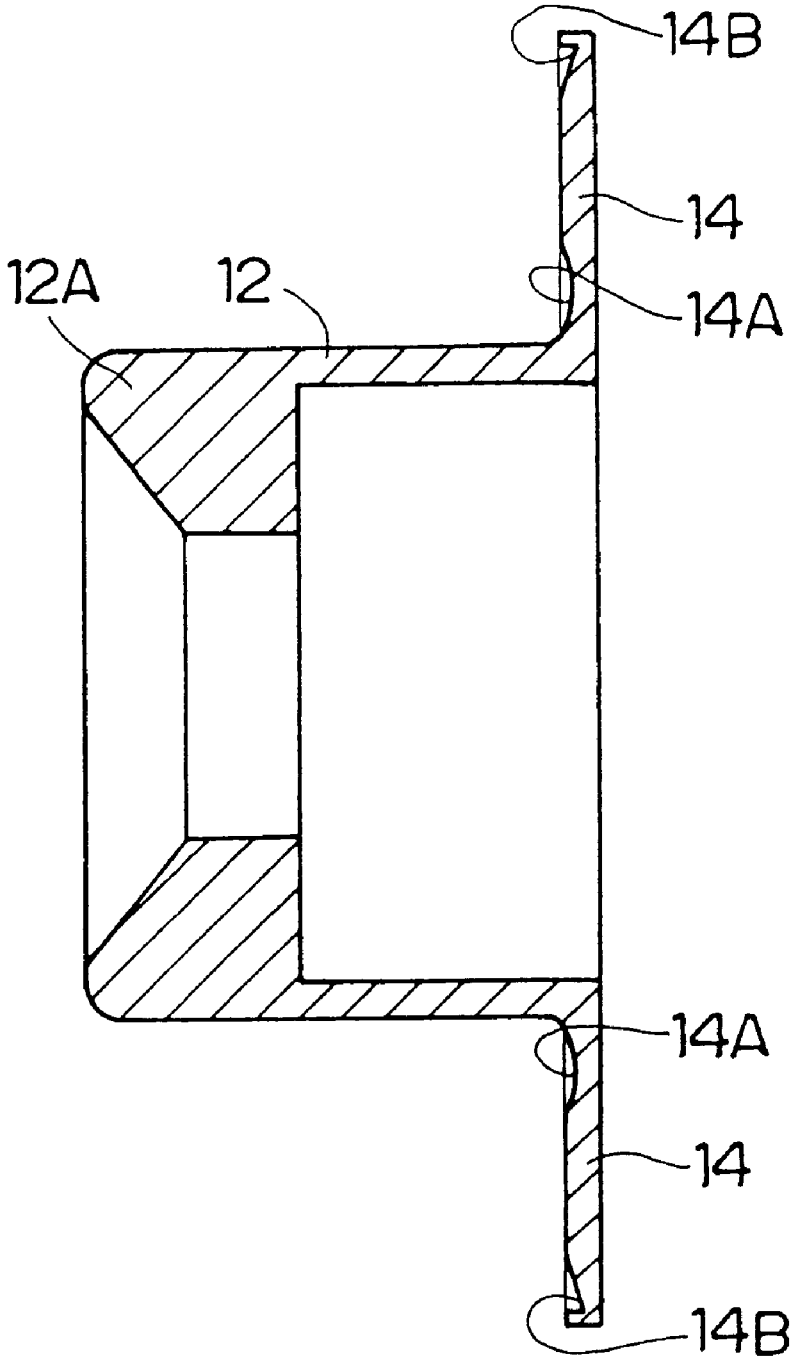
FIG. 2 is a cross-sectional view taken along line A—A of FIG. 1

The structure of the flange of the present invention is not particularly limited. However the preferred embodiment of the flange is illustrated in FIGS. 1 through 4. The flange is preferably detachably mounted to the winding core. In the figures, the flange 10 is composed of cylindrical portions 12 and a collar portion 14. At the cylindrical portion 12, a ring shaped protruding portion 12A which extends from the connecting portion (base portion) of the collar portion 14 and the cylindrical portion 12 to a front end portion on the opposite side, and protrudes into the inner portion of the cylindrical configuration (winding core) is provided. As illustrated in FIG. 1, at this ring shaped protruding portion 12A, one or more opening portions 12B are formed spaced apart at a predetermined distance in the circumferential direction of the cylindrical configuration, toward the center axis side. Further, in the vicinity of the connecting portion of the collar portion 14 and the cylindrical portion 12, a concave portion 14A which is configured as a ring and has an arcuate cross section, is formed encircling the ring-shaped protruding portion.

Figure 3:
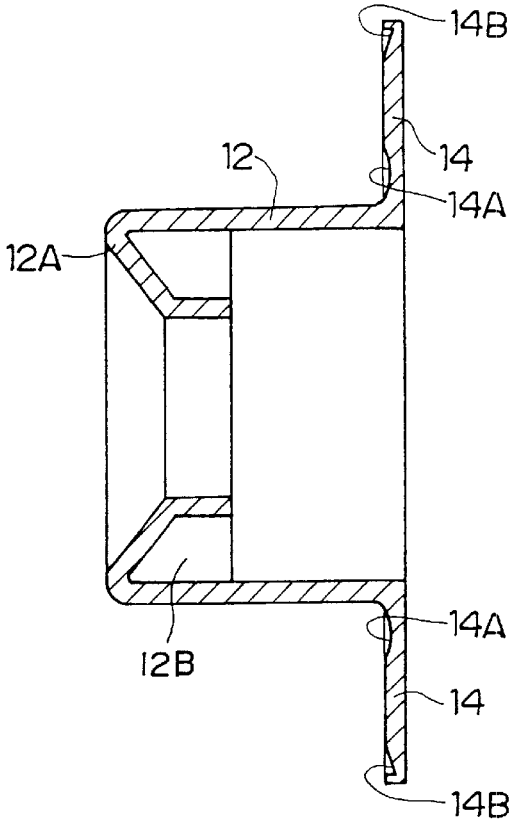
FIG. 3 is a cross-sectional view taken along line B—B of FIG. 1
Figure 4:
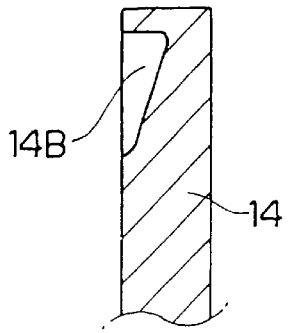
FIG. 4 is an enlarged cross-sectional view of a main portion of FIG. 1.

As illustrated in FIG. 3, a concave portion 14B which is configured as a ring and has a triangular cross section is formed.

Figure 5:
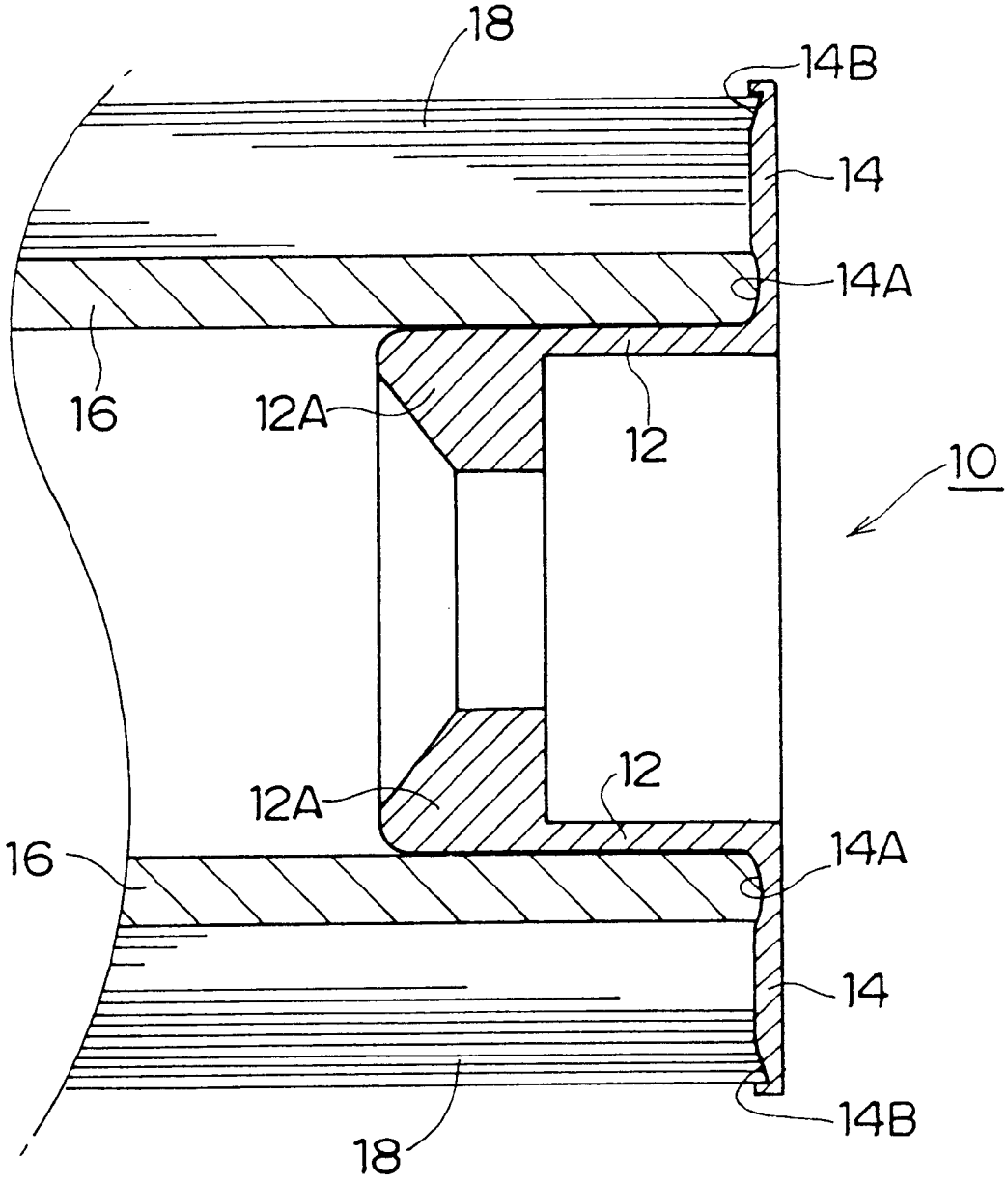
FIG. 5 is a cross-sectional view illustrating a main portion in which the flange in FIG. 1 is attached to a winding core.

The flange 10 may be formed of plastic, metal and the like, but plastic having elasticity, such as polystyrene, polypropylene and the like are preferably used. This flange 10 should be mounted to at least one end portion of the winding core, and preferably to both end portions. FIG. 5 illustrates a state in which the flange 10 is mounted to the winding core 16 and the sheet is wound onto the winding core 16. The winding core of the present invention may be formed of paper, plastic, wood or the like, but a winding core formed of paper is usually used for the winding core 16. Specifically, a Langston winding (spiral winding) type winding core is used, and the present invention is also effective in the winding core obtained from Langston winding (spiral winding).

In the case where the flange 10 is mounted on the winding core 16, the cylindrical portions 12 of the flange 10 are inserted into the inner portion of the winding core 16. At least one linear protruding portion may be formed on the surface of the cylindrical portion 12. At this time, the linear protruding portions which are disposed at the surface of the cylindrical portion 12 bite into the surface within the winding core and thereby prevent the flange 10 from skidding or idling on the winding core 16.

The sheet 18 is taken up onto the winding core 16 to which the flanges are provided in this manner. Since the flanges 10 are mounted on the winding core 16, winding error of the sheet 18 is prevented. Accordingly, when the sheet 18 is taken up onto the winding core 16, even if the sheet is loosely wound onto the winding core 16, winding error can be prevented beforehand. As a result, it is not necessary to forcefully wind the sheet onto the winding core 16. Thus, the impressions caused by the Langston winding (spiral winding) and the lines (cut portion impressions) caused by the slight step formed by the end portion of the sheet (the portion of contact with the winding core) on the winding core when the sheet is taken up on the winding core, and the like are not formed.

In the present invention, the sheet may be taken up onto the winding core having the one or two flanges mounted, or onto the winding core not having the one or two flanges mounted. In the latter case, the one or two flanges are mounted to the winding core between a step wherein the sheet is taken up onto the winding core, and a step wherein the sheet is stored in the packing body. However, the former case is more preferable than the latter case.

Further, on at least one portion of the winding core 16, and preferably at the outer peripheral portions or surface, an elastic layer may be provided. By providing the elastic layer, when the sheet which is wound onto the outer peripheral surface of the winding core 16 is superposed on the winding core 16, since the end portion of the sheet may be buried within the elastic layer, the sheet no longer forms a step portion on the outer surface of the winding core 16. Accordingly, undesirable deformation and lines on the sheet caused when the sheet is wound onto the winding core 16 is prevented. A foaming resin, a low density polyethylene, a resin having a glass transition temperature less than or equal to 25° C. (e.g., ethylene-vinyl acetate copolymer resin, polymethyl methacrylate resin, silicone rubber, and the like) are given as examples of the elastic layer, but the foaming resin is preferable.

Additionally, before taking up the sheets, when the flange 10 is mounted to the winding core 16, even if paper dust is temporarily generated, this paper dust can be suitably eliminated. At this stage, even if an operation for eliminating the paper dust is carried out, since the image forming process is not being carried out, the image forming process is not hindered. A roll into which sheet 18 is taken up on the winding core 16 to which the flange 10 is mounted, is stored in a packing material. This packing material may be any packing material normally used for packaging. For example, a carton box or a plastic bag made of polyvinyl chloride or the like may be used.

Next, an image forming method in which the above-described packaging body is used will be described. The image forming method of the present invention is one in which the ink sheet and the image receiving sheet which are respectively wound into rolls and loaded on the rack(s) are respectively pulled out from the rack(s) and the ink sheet and the image receiving sheet are irradiated image-wise with a laser beam in a state in which they are superposed, to thereby form an image. In the present invention, these sheets may be loaded on the same rack or on separate racks. These racks may be rotating racks.

In the present invention, the ink sheet and the receiving sheet which are respectively wound in rolls onto the winding core are taken out from the packaging bodies and mounted on the rack(s). Subsequently, a flange is mounted on the winding cores of the packaging bodies of the first and second objects if necessary. That is to say, in the image forming method of the present invention, the roll into which sheet 18 is wound onto the winding core 16 to which the flanges 10 are mounted, is loaded onto the rack after being taken out from the packaging body. In the case of the roll where the flange 10 is mounted to only one end of the winding core 16, after the roll is loaded onto the rack, another flange 10 is then mounted to the other end portion side of the winding core 16.

In this case, because it is not necessary to mount the flanges 10 to both end portions since the flange 10 has already been mounted to one end portion of the winding core 16, the generation of paper dust, operation trouble and the like are few in comparison with the case in which after the roll is mounted onto the rack, the flange 10 is mounted to both end portions of the winding core 16. In the case where the flanges 10 are already mounted to both end portions of the winding core 16 before taking up the sheet, simply loading the roll as it is to the rack is sufficient to significantly decrease the generation of paper dust, operation trouble and the like.

At the time of the image formation process, the sheets are pulled out from the rolls which are loaded onto the rack(s), and conveyed to the image forming portion. In the image forming portion, the ink sheet and the image receiving sheet respectively which are pulled out from the rack(s) are conveyed to the drum shaped support body and superposed onto each other.

The drum-shaped support body may be for example, a drum shaped support body having a plurality of tiny openings. In a case where this type of drum shaped support body is utilized, both sheets are vacuum-adhered by being vacuum suctioned and then irradiated image-wise with a laser beam while being rotated. After the ink layer of the ink sheet is heat-transferred image-wisely to the image receiving sheet, the ink sheet and the image receiving sheet are stripped.

These operations are carried out sequentially for each color and a color image is thereby formed. In the ink sheet and the image receiving sheet of the present invention, all known sheets may be applied.

EXAMPLE 1

Preparation of an Image Receiving Sheet

On polyethylene terephthalate (of thickness 100 μm), a coating solution for an intermediate layer of the composition below was coated to a thickness of 20 μm, to thereby form the intermediate layer. Further, a coating solution for an image receiving layer of the composition below was coated on top of this intermediate layer to a thickness of 2 μm, to thereby form the image receiving layer, and an image receiving sheet having a length of 61 m was prepared.

Composition of a coating solution for an intermediate layer

| | |
|---|---|
| MEK | 58 parts by weight |
| toluene | 13 parts by weight |
| vinyl chloride/vinyl acetate copolymer | 29 parts by weight |

Composition of a coating solution for an image receiving layer

| | |
|---|---|
| n-PrOH (n-propyl alcohol) | 5.5 parts by weight |
| MFG (PEGMEA, 1-methoxy-2-propyl acetate) | 28 parts by weight |
| methanol | 64 parts by weight |
| polyvinylbutyral | 2.5 parts by weight |

Preparation of an Ink Sheet

An ink layer was formed by coating a coating solution for the ink layer of the composition below on polyethylene terephthalate (of thickness 100 μm) to a thickness of 0.3 μm, and an ink sheet having a length of 61 m was prepared.

Composition of a Coating Solution for an Ink Layer

| | |
|---|---|
| n-PrOH | 63 parts by weight |
| MEK | 24 parts by weight |
| pigment | 12 parts by weight |
| polyvinyl butyral | 0.6 parts by weight |
| rosin | 0.2 parts by weight |
| wax | 0.2 parts by weight |

The conditions for taking up the image receiving sheet and the ink sheet respectively, which were obtained, onto general paper winding cores which were obtained by the Langston winding method, were winding with a tension of 15 kgf/m and a speed of 80 m/minute. Subsequently, the flanges illustrated in FIGS. 1 through 4, having a diameter which is 20 mm larger than the outer diameter of the winding core were mounted, and these were left for two years in carton boxes. After that, the ink sheet and the image receiving sheet which were respectively wound onto the winding cores to which flanges were mounted were taken out from the carton boxes. When the rolls were unwound, the portions of the image receiving sheet and the ink sheet which were up to 1 m away from the winding cores when in the wound state, did not generate any impressions caused by the cut portion.

Comparative Example 1

This example was effected in the same manner as Example 1, except that the flanges of Example 1 were not mounted. As a result, the winding was loose and winding error was generated when the sheet was handled.

Comparative Example 2

This example was effected in the same manner as Example 1, except that the flanges of Example 1 were not mounted and further, the conditions for winding the sheets onto the winding cores were winding with a tension of 25 kgf/m and a speed of 60 m/minute. Impressions caused by the cut end portion were generated on the portions of the image receiving sheet and the ink sheet unwound to up to 10 m.

As described above, as a result of the packaging body in the present invention, there was no winding error, and undesirable lines and impressions on the sheets which hinder image formation were not generated.

In the image forming method of the present invention, precise and accurate image formation could be carried out by a simple operation.

What is claimed is:

1. A packaging body comprising a packing material and at least one sheet packaged therein, wherein the sheet is an ink sheet for laser heat transfer recording having a winding core on which the sheet is wound, the winding core having opposite end portions and a flange mounted to at least one end portion of the winding core.

2. A packaging body of claim 1, wherein the flange is detachably mounted to the winding core.

3. A packaging body of claim 1, wherein the winding core is formed of paper.

4. A packaging body of claim 1, wherein the flange is mounted to both end portions of the winding core.

5. A packaging body of claim 1, wherein the winding core is provided with an elastic layer.

6. A packaging body of claim 5, wherein the elastic layer is formed from a foaming resin.

7. A packaging body comprising a packing material and at least one sheet packaged therein, wherein the sheet is an ink sheet for laser heat transfer recording having a winding core on which the sheet is wound, the winding core having opposite end portions and a flange mounted to at least one end portion of the winding core; and wherein the flange comprises a cylindrical portion and a collar portion, and includes at least one of:

a ring-shaped protruding portion protruding from the cylindrical portion;

a plurality of opening portions defined in the cylindrical portion;

a concavity formed in a ring shape encircling the ring-shaped protruding portion, at a connecting portion of the collar and the cylindrical portion;

a concave portion having a triangular cross-section and formed in a ring-shape at a circumferential portion of the collar portion; and a linear protruding portion disposed on an outer surface of the cylindrical portion.

8. A packaging body comprising a packing material and at least one sheet packaged therein, wherein the sheet is an image receiving sheet for laser heat transfer recording having a winding core on which the sheet is wound, the winding core having opposite end portions and a flange mounted to at least one end portion of the winding core.

9. A packaging body of claim 8, wherein the flange is dismountably attached to the winding core.

10. A packaging body of claim 8, wherein the winding core is formed of paper.

11. A packaging body of claim 8, wherein the flange is mounted to both end portions of the winding core.

12. A packaging body of claim 8, wherein the winding core is provided with an elastic layer.

13. A packaging body of claim 12, wherein the elastic layer is formed from a foaming resin.

14. A packaging body comprising a packing material and at least one sheet packaged therein, wherein the sheet is an image receiving sheet for laser heat transfer recording having a winding core on which the sheet is wound, the winding core having opposite end portions and a flange mounted to at least one end portion of the winding core; and wherein the flange comprises a cylindrical portion and a collar portion, and includes at least one of:

a ring-shaped protruding portion protruding from the cylindrical portion;

a plurality of opening portions defined in the cylindrical portion;

a concavity formed in a ring shape encircling the ring-shaped protruding portion, at a connecting portion of the collar and the cylindrical portion;

a concave portion having a triangular cross-section and formed in a ring shape at a circumferential portion of the collar portion; and a linear protruding portion disposed on an outer surface of the cylindrical portion.

15. An image forming method comprising the steps of:

providing a packaging body having a packing material and at least one ink sheet for laser heat transfer recording, with the ink sheet wound on an ink sheet winding core and packaged in the packing material, and a packaging body having a packing material and at least one image receiving sheet for laser sheet transfer recording, with the receiving sheet wound on a receiving sheet winding core and packaged in the packing material, wherein at least one flange is mounted to at least one of the winding cores;

removing the ink sheet together with the ink sheet winding core and the image receiving sheet together with the receiving sheet winding core from their respective packing material;

loading the sheets onto at least one rack;

selecting an end portion of one winding core which does not have a flange mounted thereto and mounting another flange to the selected end portion;

dispensing the ink sheet and the image sheet from their respective rack;

superposing the ink sheet and the image receiving sheet; and irradiating a laser image-wise onto the ink sheet and the image receiving sheet while they are superposed to thereby form an image.

16. An image forming method of claim 15, further comprising the step of vacuum suctioning the ink sheet and the image receiving sheet to a drum-shaped support body having a perforated outer surface, while the ink sheet and the image receiving sheet are superposed, prior to the step of irradiating a laser image-wise.

17. An image forming method of claim 15, wherein said one of the winding cores is the winding core for the ink sheet.

18. An image forming method of claim 15, wherein said one of the winding cores is the winding core for the receiving sheet.

19. An image forming method according claim 15, wherein the step of selecting includes detachably mounting the flange to the selected end portion.

20. An image forming method of claim 15, further comprising a step of stripping the ink sheet and the image receiving sheet apart from one another.

21. An image forming method comprising the steps of:

providing a first packaging body having a first packing material and a first sheet that is one of an ink sheet and image receiving sheet for laser heat transfer recording, with the first sheet wound on a first sheet winding core and packaged in the first packing material; and providing a second packaging body having a second packing material and a second sheet that is the other of the ink sheet and image receiving sheet for laser sheet transfer recording, with the second sheet wound on a second sheet winding core and packaged in the second packing material, wherein at least one flange is mounted to at least one of the first and second sheet winding cores;

removing the first sheet together with the first sheet winding core and the second sheet together with the second sheet winding core from their respective packing material;

loading the first and second sheets onto at least one rack;

selecting an end portion of one of the first and second winding cores that does not have a flange mounted thereto and mounting another flange to the selected end portion;

dispensing the first sheet and the second sheet from their respective rack;

superposing the first sheet and the second sheet; and irradiating a laser image-wise onto the first sheet and the second sheet while these two sheets are superposed to thereby form an image.

22. An image forming method comprising the steps of:

providing a first packaging body having a first packing material and a first sheet that is one of an ink sheet and image receiving sheet for laser heat transfer recording, with the first sheet wound on a first sheet winding core and packaged in the first packing material, wherein at least one flange is mounted to the first sheet winding core;

removing the first sheet together with the first sheet winding core from the first packing material;

loading the first sheet onto a rack;

selecting an end portion of the first winding core that does not have a flange mounted thereto and mounting another flange to the selected end portion;

dispensing the first sheet from the rack;

superposing the first sheet and a second sheet; and irradiating a laser image onto the first sheet and the second sheet while these two sheets are superposed to thereby form an image.

* * * * *